US011210977B2

(12) United States Patent
Nam

(10) Patent No.: US 11,210,977 B2
(45) Date of Patent: Dec. 28, 2021

(54) DISPLAY DEVICE

(71) Applicant: SAMSUNG DISPLAY CO., LTD., Yongin-si (KR)

(72) Inventor: Yanguk Nam, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/797,198

(22) Filed: Feb. 21, 2020

(65) Prior Publication Data

US 2020/0365067 A1 Nov. 19, 2020

(30) Foreign Application Priority Data

May 14, 2019 (KR) ..... 10-2019-0056399

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2310/08* (2013.01); *G09G 2330/021* (2013.01); *G09G 2330/04* (2013.01)

(58) Field of Classification Search
None
See application file for complete search history.

(56) References Cited

U.S. PATENT DOCUMENTS

2015/0194800 A1* 7/2015 Kim ..... G09G 3/3677 361/95
2016/0071455 A1* 3/2016 Jung ..... G09G 3/20 345/209

FOREIGN PATENT DOCUMENTS

| | | |
|---|---|---|
| KR | 10-2006-0109137 | 10/2006 |
| KR | 10-0921207 | 10/2009 |
| KR | 10-2014-0074696 | 6/2014 |
| KR | 10-1970561 | 4/2019 |

* cited by examiner

*Primary Examiner* — Stephen T. Reed
(74) *Attorney, Agent, or Firm* — F. Chau & Associates, LLC

(57) ABSTRACT

Systems and methods are described for preventing damage from overcurrent flows in a display device. The display device may include a display panel, a display panel driving circuit, and a driving control circuit. The display device also includes, a power management integrated circuit and a display panel protection circuit. If an overcurrent condition is detected, the display panel protection circuit may periodically mask frames from being sent to the display panel to prevent damage.

20 Claims, 11 Drawing Sheets

FIG. 3

| DETECTION VALUE | RANGE(1) | RANGE(2) | RANGE(3) | RANGE(4) | ... | RANGE(32) |
|---|---|---|---|---|---|---|
| REGISTER DATA | 00000 | 00001 | 00010 | 00011 | ... | 11111 |
| MASKING DRIVING | OFF | 1:1 | 1:2 | 1:3 | ... | SHUT DOWN |

DISPLAY DEVICE

CROSS-REFERENCE TO RELATED APPLICATION(S)

This application claims priority under 35 USC § 119 to Korean Patent Application No. 10-2019-0056399, filed on May 14, 2019 in the Korean Intellectual Property Office (KIPO), the contents of which are incorporated by reference herein in its entirety.

BACKGROUND

1. Technical Field

Example embodiments relate generally to a display device. More particularly, embodiments of the present inventive concept relate to a display device that prevents a product liability (PL) accident that can occur as an overcurrent flows in a display panel.

2. Description of the Related Art

Display devices are found in televisions, computers, mobile electronics, and automobiles, among other examples. Automotive display devices can display images related to radio control, climate control, speed, navigation or diagnostics. Some display devices are susceptible to overcurrent, leading to possible display damages and safety concerns.

Overcurrent is a current load in excess of specific safety ratings that can lead to a circuit overload, short circuit, or a ground fault. The result of overcurrent can be an excessive amount of heat in a display, increasing fire or damage risk to the display panel. For example, excessive heat to a display panel can cause a display panel to be non-operational, increasing the risk of vehicle accidents. Additionally, if heat is very high, there are possible fire risks, putting life in immediate danger. Therefore, there is an opportunity to improve the design of the display device to prevent vehicle accidents due to the damages of the display panel, while continuously operating the display panel.

SUMMARY

Some example embodiments provide a display device that can prevent damages of a display panel and/or a product liability accident due to the damages of the display panel while continuously operating the display panel when an overcurrent flows in the display panel.

According to an aspect of example embodiments, a display device may include a display panel configured to display an image, a display panel driving circuit configured to drive the display panel by generating a gate signal based on a clock signal, a first driving voltage corresponding to a gate-on voltage, and a second driving voltage corresponding to a gate-off voltage, by generating a data signal based on input data, and by providing the gate signal and the data signal to the display panel, a driving control circuit configured to control the display panel driving circuit by providing the clock signal and the input data to the display panel driving circuit and by providing at least one control signal to the display panel driving circuit, a power management integrated circuit configured to provide the first driving voltage and the second driving voltage to the display panel driving circuit through a first output terminal and a second output terminal, respectively, and a display panel protection circuit configured to monitor the first driving voltage of the first output terminal, to determine at least one frame following a current frame as a masking frame according to a masking ratio when the first driving voltage is out of a first reference voltage range, and to prevent the driving control circuit from providing the clock signal and the input data to the display panel driving circuit during the masking frame.

In example embodiments, the display panel protection circuit may determine whether the driving control circuit is to provide the clock signal and the input data to the display panel driving circuit by monitoring the first driving voltage in normal frames during which the image is displayed.

In example embodiments, the masking ratio may indicate a ratio of a number of the masking frames during a period of a masking driving to a number of normal frames that during the period. In addition, the masking ratio may be stored in a mapping table form in a memory device and may be referred to by the display panel protection circuit.

In example embodiments, the masking ratio may be constant regardless of a magnitude of the first driving voltage. In example embodiments, the masking ratio may be changed according to a magnitude of the first driving voltage.

In example embodiments, the masking ratio may increase as an amount by which the first driving voltage is out of the first reference voltage range increases, and a driving frequency of the display panel may decrease as the masking ratio increases.

In example embodiments, the masking ratio may decrease as an amount by which the first driving voltage is out of the first reference voltage range decreases, and a driving frequency of the display panel may increase as the masking ratio decreases.

According to another aspect of example embodiments, a display device may include a display panel configured to display an image, a display panel driving circuit configured to drive the display panel by generating a gate signal based on a clock signal, a first driving voltage corresponding to a gate-on voltage, and a second driving voltage corresponding to a gate-off voltage, by generating a data signal based on input data, and by providing the gate signal and the data signal to the display panel, a driving control circuit configured to control the display panel driving circuit by providing the clock signal and the input data to the display panel driving circuit and by providing at least one control signal to the display panel driving circuit, a power management integrated circuit configured to provide the first driving voltage and the second driving voltage to the display panel driving circuit through a first output terminal and a second output terminal, respectively, and a display panel protection circuit configured to monitor the second driving voltage of the second output terminal, to determine at least one frame following a current frame as a masking frame according to a masking ratio when the second driving voltage is out of a second reference voltage range, and to prevent the driving control circuit from providing the clock signal and the input data to the display panel driving circuit during the masking frame.

In example embodiments, the display panel protection circuit may determine whether the driving control circuit is to provide the clock signal and the input data to the display panel driving circuit by monitoring the second driving voltage in normal frames during which the image is displayed.

In example embodiments, the masking ratio may indicate a ratio of a number of the masking frames during a period of a masking driving to a number of normal frames that during the period. In addition, the masking ratio may be stored in a mapping table form in a memory device and may be referred to by the display panel protection circuit.

In example embodiments, the masking ratio may be constant regardless of a magnitude of the second driving voltage. In example embodiments, the masking ratio may be changed according to a magnitude of the second driving voltage.

In example embodiments, the masking ratio may increase as an amount by which the second driving voltage is out of the second reference voltage range increases, and a driving frequency of the display panel may decrease as the masking ratio increases.

In example embodiments, the masking ratio may decrease as an amount by which the second driving voltage is out of the second reference voltage range decreases, and a driving frequency of the display panel may increase as the masking ratio decreases.

According to still another aspect of example embodiments, a display device may include a display panel configured to display an image, a display panel driving circuit configured to drive the display panel by generating a gate signal based on a clock signal, a first driving voltage corresponding to a gate-on voltage, and a second driving voltage corresponding to a gate-off voltage, by generating a data signal based on input data, and by providing the gate signal and the data signal to the display panel, a driving control circuit configured to control the display panel driving circuit by providing the clock signal and the input data to the display panel driving circuit and by providing at least one control signal to the display panel driving circuit, a power management integrated circuit configured to provide the first driving voltage and the second driving voltage to the display panel driving circuit through a first output terminal and a second output terminal, respectively, and a display panel protection circuit configured to monitor at least one selected from a first current flowing through the first output terminal and a second current flowing through the second output terminal, to determine at least one frame following a current frame as a masking frame according to a masking ratio when the at least one selected from the first current and the second current is judged to be an overcurrent, and to prevent the driving control circuit from providing the clock signal and the input data to the display panel driving circuit during the masking frame.

In example embodiments, the display panel protection circuit may determine whether the driving control circuit is to provide the clock signal and the input data to the display panel driving circuit by monitoring the at least one selected from the first current and the second current in normal frames during which the image is displayed.

In example embodiments, the masking ratio may indicate a ratio of a number of the masking frames during a period of a masking driving to a number of a normal frame that is implemented during the period. In addition, the masking ratio may be stored in a mapping table form in a memory device and may be referred to by the display panel protection circuit.

In example embodiments, the masking ratio may be constant regardless of a magnitude of the overcurrent. In example embodiments, the masking ratio may be changed according to a magnitude of the overcurrent.

In example embodiments, the masking ratio may increase as the overcurrent increases, and a driving frequency of the display panel may decrease as the masking ratio increases. In addition, the masking ratio may decrease as the overcurrent decreases, and the driving frequency of the display panel may increase as the masking ratio decreases.

Therefore, a display device according to example embodiments may monitor a driving voltage (e.g., a first driving voltage corresponding to a gate-on voltage and/or a second driving voltage corresponding to a gate-off voltage) that is provided from a power management integrated circuit to a display panel driving circuit, may determine at least one frame following a current frame as a masking frame according to a masking ratio when the driving voltage is out of a specific reference voltage range, and may control a driving control circuit not to provide a clock signal and input data to the display panel driving circuit during the masking frame. Thus, the display device may minimize damages of the display panel due to an overcurrent flowing in the display panel while continuously displaying an image on the display panel by reducing only the number of a normal frame (i.e., reducing only a driving frequency of the display panel) according to the masking ratio when the overcurrent flows in the display panel. As a result, the display device may prevent the damages of the display panel and/or a product liability accident due to the damages of the display panel while continuously operating the display panel when the overcurrent flows in the display panel.

In addition, a display device according to example embodiments may monitor a current flowing between a power management integrated circuit and a display panel driving circuit, may determine at least one frame following a current frame as a masking frame according to a masking ratio when the current is out of a specific reference current range (i.e., when the current is judged to be an overcurrent), and may control a driving control circuit not to provide a clock signal and input data to the display panel driving circuit during the masking frame. Thus, the display device may minimize damages of the display panel due to an overcurrent flowing in the display panel while continuously displaying an image on the display panel by reducing only the number of a normal frame (i.e., reducing only a driving frequency of the display panel) according to the masking ratio when the overcurrent flows in the display panel. As a result, the display device may prevent the damages of the display panel and/or a product liability accident due to the damages of the display panel while continuously operating the display panel when the overcurrent flows in the display panel.

According to another aspect of the inventive concept, a method of operating a display device is described. The method may include monitoring electric power provided to a display panel; identifying an overcurrent condition based on the monitoring, wherein the overcurrent condition comprises a current exceeding a current threshold or a voltage exceeding a voltage threshold; and reducing a display frequency of the display panel based on identifying the overcurrent condition.

In some examples, reducing the display frequency further comprises identifying a masking ratio based on the overcurrent condition; identifying one or more masking frames based on the masking ratio; and preventing a signal from being provided to the display panel during the one or more masking frames.

BRIEF DESCRIPTION OF THE DRAWINGS

Illustrative, non-limiting example embodiments will be more clearly understood from the following detailed description in conjunction with the accompanying drawings.

FIG. 3 is a diagram illustrating an example in which a masking ratio is determined by a display panel protection circuit included in the display device of FIG. 1.

DETAILED DESCRIPTION OF THE EMBODIMENTS

When an overcurrent flows in a display panel of a display device, the display panel may be damaged, and thus a product liability accident such as an explosion, ignition, or fire of the display panel may occur due to excessive heat of the display panel. In some cases, a display device in an overcurrent event performs a function to disable the display panel. For example, if the display unit of a vehicle does not operate due to an overcurrent event, a vehicle accident may occur. Additionally, a vehicle display may also ignite and injury a user if the display is not disabled.

Hereinafter, embodiments of the present inventive concept will be explained in detail with reference to the accompanying drawings.

Figure 1:
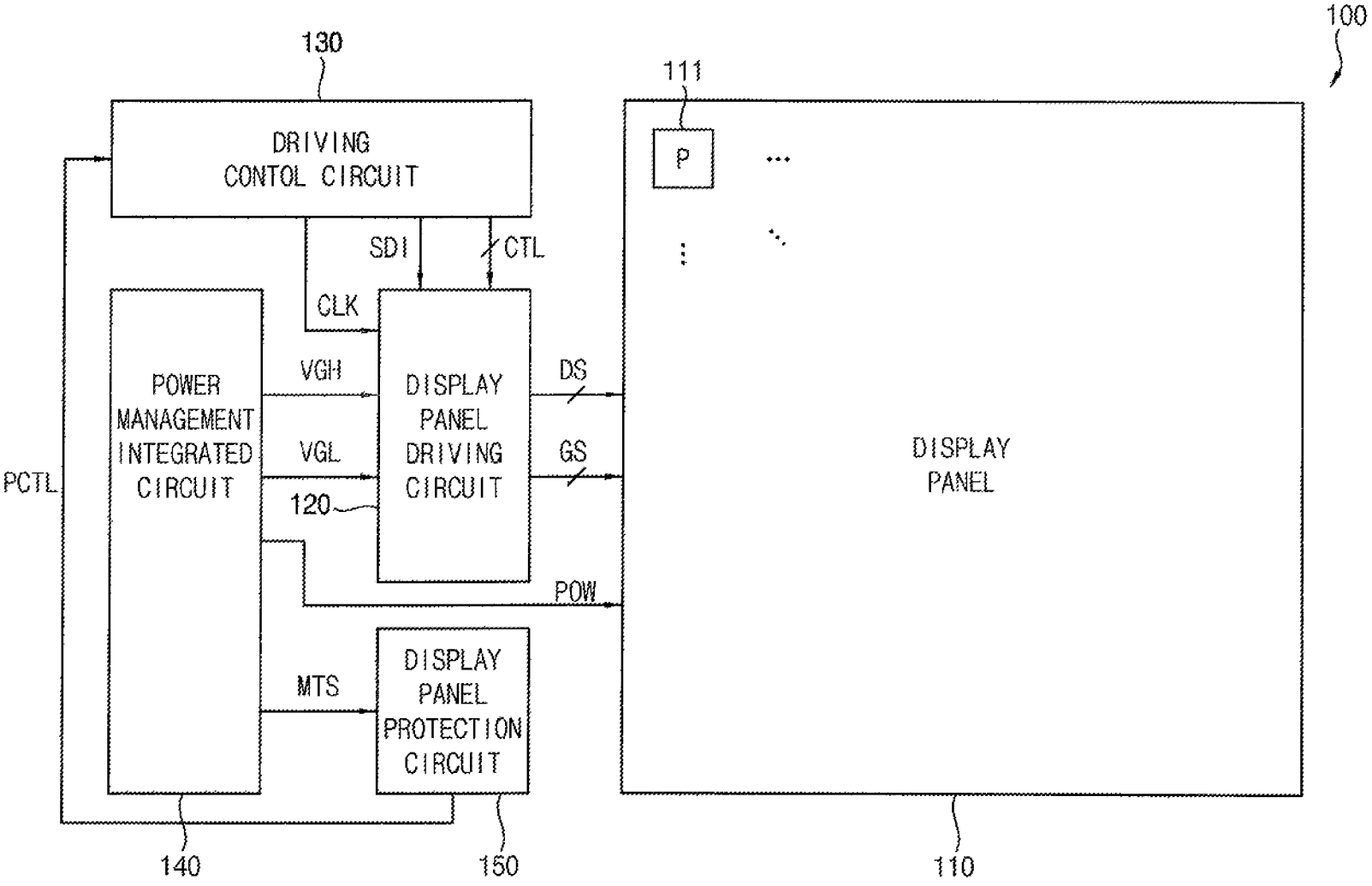
FIG. 1 is a block diagram illustrating a display device according to example embodiments.
Figure 2A:
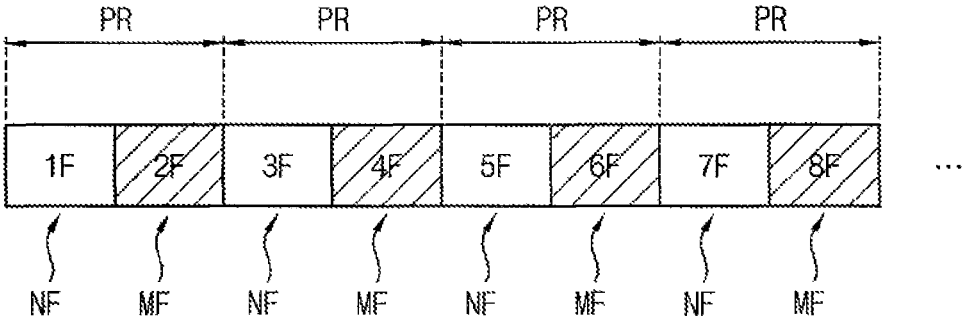
FIGS. 2A to 2C are diagrams illustrating examples in which a masking driving is performed by the display device of FIG. 1.
Figure 2B:
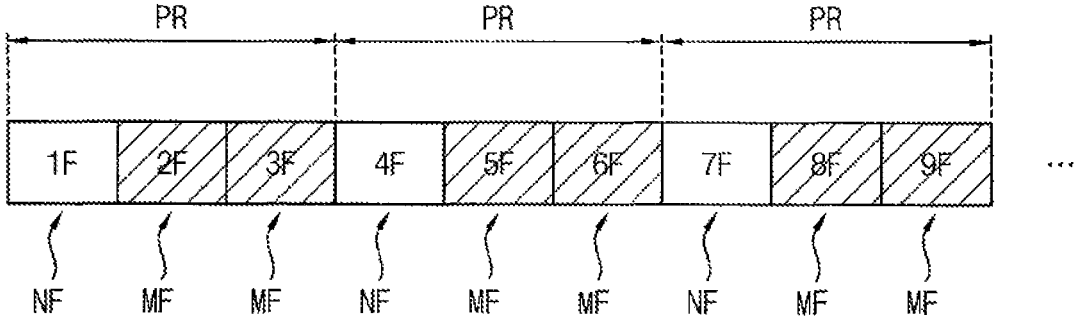
Figure 2C:
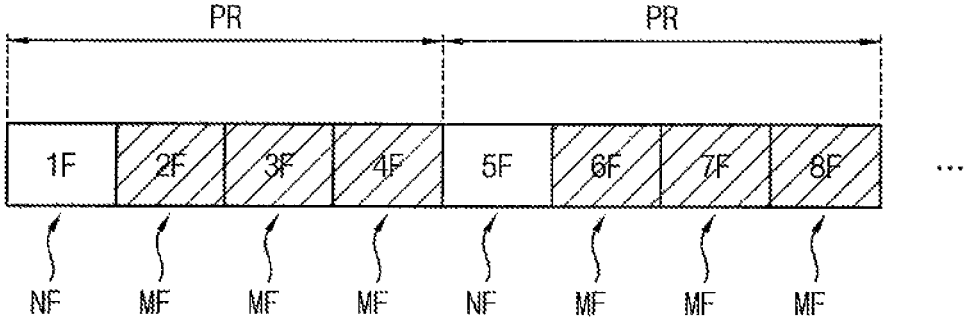

FIG. 1 is a block diagram illustrating a display device according to example embodiments, FIGS. 2A to 2C are diagrams illustrating examples in which a masking driving is performed by the display device of FIG. 1, and FIG. 3 is a diagram illustrating an example in which a masking ratio is determined by a display panel protection circuit included in the display device of FIG. 1.

Referring to FIGS. 1 to 3, the display device 100 may include a display panel 110, a display panel driving circuit 120, a driving control circuit 130 (or referred to as a timing control circuit, etc.), a power management integrated circuit 140, and a display panel protection circuit 150. In an example embodiment, the display device 100 may be an organic light-emitting display (OLED) device. In another example embodiment, the display device 100 may be a liquid crystal display (LCD) device. However, the display device 100 is not limited thereto.

The display panel 110 may include a plurality of pixels 111. The display panel 110 may display an image based on color lights output from the pixels 111. In an example embodiment, the pixels 111 may include red color display pixels that output a red color light, green color display pixels that output a green color light, and blue color display pixels that output a blue color light. In another example embodiment, the pixels 111 may include red color display pixels that output a red color light, green color display pixels that output a green color light, blue color display pixels that output a blue color light, and white color display pixels that output a white color light. The pixels 111 may be arranged in various forms (e.g., a matrix form, etc.) in the display panel 110. The display panel driving circuit 120 may drive the display panel 110. To this end, the display panel driving circuit 120 may include a gate driver, a data driver, etc.

The display panel 110 may be electrically connected to the gate driver via a plurality of gate-lines and to the data driver via a plurality of data-lines. The gate driver may provide a gate signal GS to the display panel 110 via the gate-lines. The gate driver may generate the gate signal GS based on a clock signal CLK, a first driving voltage VGH corresponding to a gate-on voltage, and a second driving voltage VGL corresponding to a gate-off voltage.

The data driver may provide a data signal DS to the display panel 110 via the data-lines. The data driver may generate the data signal DS based on input data SDI. The display panel driving circuit 120 may drive the display panel 110 by providing the gate signal GS and the data signal DS to the display panel 110. The driving control circuit 130 may control the display panel driving circuit 120 by providing at least one control signal CTL to the display panel driving circuit 120. For example, the driving control circuit 130 may control the gate driver, the data driver, etc by generating and providing at least one control signal CTL to the gate driver, the data driver, etc.

In some example embodiments, the driving control circuit 130 may perform a processing function (e.g., image data compensation, etc) on image data input from an external component. In addition, the driving control circuit 130 may be integrated with the display panel driving circuit 120 as one integrated chip. The driving control circuit 130 may provide the clock signal CLK and the input data SDI to the display panel driving circuit 120. For example, the driving control circuit 130 may provide the clock signal CLK to the gate driver to generate the gate signal GS. The gate driver may be included in the display panel driving circuit 120. Additionally, the driving control circuit 130 may provide the input data SDI to the data driver to generate the data signal DS. The data driver may be included in the display panel driving circuit 120.

The power management integrated circuit 140 may provide the display panel 110 with power POW for operations of the display panel 110. The power management integrated circuit 140 may provide the first driving voltage VGH corresponding to the gate-on voltage to the display panel driving circuit 120 through a first output terminal and may provide the second driving voltage VGL corresponding to the gate-off voltage to the display panel driving circuit 120 through a second output terminal. Thus, the gate driver included in the display panel driving circuit 120 may generate the gate signal GS using the first driving voltage VGH, the second driving voltage VGL, the clock signal CLK. The first driving voltage VGH may be a constant-voltage. The second driving voltage VGL may also be a constant-voltage. Therefore, a first voltage level of the gate signal GS (i.e., the gate-on voltage) may be a voltage level of the first driving voltage VGH (e.g., a positive voltage level). Additionally, a second voltage level of the gate signal GS (i.e., the gate-off voltage) may be a voltage level of the second driving voltage VGL (e.g., a negative voltage level or a ground voltage level).

When the overcurrent flows in the display panel 110, the display panel protection circuit 150 may minimize damages of the display panel 110 due to an overcurrent flowing in the display panel 110 while continuously displaying an image on the display panel 110 by reducing, for example, a driving frequency of the display panel 110. The luminance of the display panel 110 may be lowered as the number of normal frames is reduced. Generally, when a short circuit and the like of wirings included in the display panel 110 occur, the overcurrent may flow in the display panel 110. Thus, due to the overcurrent flows between the power management integrated circuit 140 and the display panel driving circuit 120, the display panel protection circuit 150 may determine whether the overcurrent flows in the display panel 110 by monitoring whether the overcurrent flows between the power management integrated circuit 140 and the display panel driving circuit 120 (i.e., indicated by MTS). In addition, when the overcurrent flows in the display panel 110 as the short circuit and the like of the wirings included in the display panel 110 occur, the first driving voltage VGH and/or the second driving voltage VGL that the power management integrated circuit 140 provides to the display panel driving circuit 120 may be changed.

For example, a voltage level of the first driving voltage VGH having a positive voltage level may be decreased, and a voltage level of the second driving voltage VGL having a negative voltage level or a ground voltage level may be increased. Thus, the display panel protection circuit 150 may determine whether the overcurrent flows in the display panel 110 by monitoring whether the first driving voltage VGH and/or the second driving voltage VGL that the power management integrated circuit 140 provides to the display panel driving circuit 120 may be changed (i.e., indicated by MTS).

In example embodiments, the display panel protection circuit 150 may determine a portion of frames as a masking frame MF when the overcurrent flows in the display panel 110 and may control the driving control circuit 130 not to provide the clock signal CLK and the input data SDI to the display panel driving circuit 120 during the masking frame MF (i.e., indicated by PCTL). As a result, the damages of the display panel 110 may be prevented due to no current flows in the display panel 110 during the masking frame MF. Because a portion of charges stored in a storage capacitor of the pixel 111 during the normal frame NF is maintained during the masking frame MF, a fully black image may not be displayed on the display panel 110 during the masking frame MF.

In an example embodiment, the display panel protection circuit 150 may monitor the first driving voltage VGH of the first output terminal of the power management integrated circuit 140. Additionally, the display panel protection circuit 150 may determine at least one frame following a current frame as the masking frame MF according to a masking ratio when the first driving voltage VGH is outside of the first reference voltage range. The display panel protection circuit 150 may also control the driving control circuit 130 not to provide the clock signal CLK and the input data SDI to the display panel driving circuit 120 during the masking frame MF. An embodiment will be described in detail with reference to FIGS. 4 and 5.

In another example embodiment, the display panel protection circuit 150 may monitor the second driving voltage VGL of the second output terminal of the power management integrated circuit 140. Additionally, the display panel protection circuit 150 may determine at least one frame following a current frame as the masking frame MF according to a masking ratio when the second driving voltage VGL is outside of the second reference voltage range. The display panel protection circuit 150 may also control the driving control circuit 130 not to provide the clock signal CLK and the input data SDI to the display panel driving circuit 120 during the masking frame MF. An embodiment will be described in detail with reference to FIGS. 6 and 7.

In still another example embodiment, the display panel protection circuit 150 may monitor at least one selected from a first current flowing through the first output terminal of the power management integrated circuit 140 and a second current flowing through the second output terminal of the power management integrated circuit 140. Additionally, the display panel protection circuit 150 may determine at least one frame following a current frame as the masking frame MF according to a masking ratio when the at least one selected from the first current and the second current is judged to be the overcurrent. The display panel protection circuit 150 may also control the driving control circuit 130 not to provide the clock signal CLK and the input data SDI to the display panel driving circuit 120 during the masking frame MF. An embodiment will be described in detail with reference to FIGS. 8 and 9.

The display panel protection circuit 150 may determine at least one frame following a current frame as the masking frame MF, according to the masking ratio, when the overcurrent flows in the display panel 110. The display panel protection circuit 150 may also control the display panel 110 not to operate by controlling the clock signal CLK and the input data SDI not to be provided to the display panel driving circuit 120 during the masking frame MF. As a result, since the number of normal frames NF is reduced by the number of masking frames MF, the damages of the display panel 110 may be minimized. Damage of the display panel 110 may be minimized by reducing the number of times the display panel 110 displays an image. Thus, the display panel 110 may safely and continuously operate at a reduced driving frequency.

As described above, the display panel protection circuit 150 may reduce the number of normal frames NF by determining at least one frame following a current frame as the masking frame MF according to the masking ratio when the overcurrent flows in the display panel 110. The display panel protection circuit 150 may determine whether the driving control circuit 130 is to provide the clock signal CLK and the input data SDI to the display panel driving circuit 120 by monitoring whether the overcurrent flows in the display panel 110 in each normal frame NF that implements an image. In the masking frame MF, the display panel protection circuit 150 may not monitor whether the overcurrent flows in the display panel 110. In an example embodiment, the masking ratio may indicate a ratio of the number of the masking frames MF implemented during a period PR of a masking driving to the number of normal frames NF implemented during a period PR of the masking driving.

Thus, a method of operating a display device may include monitoring electric power provided to a display panel 110; identifying an overcurrent condition based on the monitoring, wherein the overcurrent condition comprises a current exceeding a current threshold or a voltage exceeding a voltage threshold; and reducing a display frequency of the display panel 110 based on identifying the overcurrent condition.

In some examples, reducing the display frequency further comprises identifying a masking ratio based on the overcurrent condition; identifying one or more masking frames MF based on the masking ratio; and preventing a signal from being provided to the display panel 110 during the one or more masking frames MF.

For example, FIG. 2A shows an example in which the masking ratio is set to be 1:1. The display panel protection circuit 150 may determine a second frame 2F following a current frame (i.e., a first frame 1F) as the masking frame MF, according to the masking ratio of 1:1, when it is determined that the overcurrent flows in the display panel 110 in the first frame 1F which is the normal frame NF. Additionally, the display panel protection circuit 150 may determine a fourth frame 4F following a current frame (i.e., a third frame 3F) as the masking frame MF, according to the masking ratio of 1:1, when it is determined that the overcurrent flows in the display panel 110 in the third frame 3F which is the normal frame NF, The display panel protection circuit 150 may also determine a sixth frame 6F following a current frame (i.e., a fifth frame 5F) as the masking frame MF, according to the masking ratio of 1:1, when it is determined that the overcurrent flows in the display panel 110 in the fifth frame 5F which is the normal frame NF. The display panel protection circuit 150 may also determine an eighth frame 8F following a current frame (i.e., a seventh frame 7F) as the masking frame MF, according to the masking ratio of 1:1, when it is determined that the overcurrent flows in the display panel 110 in the seventh frame 7F which is the normal frame NF. As a result, when the masking ratio is set to be 1:1, one normal frame NF and one masking frame MF may be implemented during a period PR of the masking driving. In this case, when a normal driving frequency of the display panel 110 is 120 Hz, the driving frequency of the display panel 110 may become 60 Hz as the masking driving is performed.

For example, FIG. 2B shows an example in which the masking ratio is set to be 1:2. The display panel protection circuit 150 may determine a second frame 2F and a third frame 3F following a current frame (i.e., a first frame 1F) as the masking frame MF, according to the masking ratio of 1:2, when it is determined that the overcurrent flows in the display panel 110 in the first frame 1F which is the normal frame NF. Additionally, the display panel protection circuit 150 may determine a fifth frame 5F and a sixth frame 6F following a current frame (i.e., a fourth frame 4F) as the masking frame MF, according to the masking ratio of 1:2, when it is determined that the overcurrent flows in the display panel 110 in the fourth frame 4F which is the normal frame NF. The display panel protection circuit 150 may also determine an eighth frame 8F and a ninth frame 9F following a current frame (i.e., a seventh frame 7F) as the masking frame MF, according to the masking ratio of 1:2, when it is determined that the overcurrent flows in the display panel 110 in the seventh frame 7F which is the normal frame NF. As a result, when the masking ratio is set to be 1:2, one normal frame NF and two masking frames MF may be implemented during a period PR of the masking driving. In this case, when a normal driving frequency of the display panel 110 is 120 Hz, the driving frequency of the display panel 110 may become 40 Hz as the masking driving is performed.

For example, FIG. 2C shows an example in which the masking ratio is set to be 1:3. The display panel protection circuit 150 may determine a second frame 2F, a third frame 3F, and a fourth frame 4F following a current frame (i.e., a first frame 1F) as the masking frame MF, according to the masking ratio of 1:3, when it is determined that the overcurrent flows in the display panel 110 in the first frame 1F which is the normal frame NF. The display panel protection circuit 150 may also determine a sixth frame 6F, a seventh frame 7F, and an eighth frame 8F following a current frame (i.e., a fifth frame 5F) as the masking frame MF according to the masking ratio of 1:3, when it is determined that the overcurrent flows in the display panel 110 in the fifth frame 5F which is the normal frame NF. As a result, when the masking ratio is set to be 1:3, one normal frame NF and three masking frames MF may be implemented during a period PR of the masking driving. In this case, when a normal driving frequency of the display panel 110 is 120 Hz, the driving frequency of the display panel 110 may become 30 Hz as the masking driving is performed.

In example embodiments, the masking ratio may be stored in a mapping table form in a memory device and may be referred to by the display panel protection circuit 150. For example, the memory device that stores the masking ratio may be located inside the display panel protection circuit 150. For example, the memory device that stores the masking ratio may be located outside the display panel protection circuit 150. In an example embodiment, when the overcurrent flows in the display panel 110, the masking ratio may be constant, regardless of the magnitude of the overcurrent. For example, when the display panel protection circuit 150 monitors the first driving voltage VGH that the power management integrated circuit 140 provides to the display panel driving circuit 120, the masking ratio may be constant regardless of the magnitude of the first driving voltage VGH. For example, when the display panel protection circuit 150 monitors the second driving voltage VGL that the power management integrated circuit 140 provides to the display panel driving circuit 120, the masking ratio may be constant regardless of the magnitude of the second driving voltage VGL. For example, the masking ratio may be constant, regardless of the magnitude of the overcurrent, when the display panel protection circuit 150 monitors an overcurrent flowing between the power management integrated circuit 140 and the display panel driving circuit 120. In another example embodiment, the masking ratio may be changed according to a magnitude of the overcurrent when the overcurrent flows in the display panel 110. For example, when the display panel protection circuit 150 monitors the first driving voltage VGH that the power management integrated circuit 140 provides to the display panel driving circuit 120, the masking ratio may be changed according to a magnitude of the first driving voltage VGH. For example, when the display panel protection circuit 150 monitors the second driving voltage VGL that the power management integrated circuit 140 provides to the display panel driving circuit 120, the masking ratio may be changed according to a magnitude of the second driving voltage VGL. For example, the masking ratio may be changed according to a magnitude of the overcurrent when the display panel protection circuit 150 monitors an overcurrent flowing between the power management integrated circuit 140 and the display panel driving circuit 120.

In an example embodiment, the masking ratio may increase as an overcurrent flowing in the display panel 110 increases, and the driving frequency of the display panel 110 may decrease as the masking ratio increases. In addition, the masking ratio may decrease as an overcurrent flowing in the display panel 110 decreases, and the driving frequency of the display panel 110 may increase as the masking ratio decreases. The masking ratio may be stored in the mapping table form in the memory device. For example, as illustrated in FIG. 3, different register data may be allocated to respective ranges of a detection value that the display panel detection circuit 150 detects, and different masking ratios may be mapped to respective register data. Register data may be indicated by '00000' to '11111'. Ranges may be indicated by RANGE(1) to RANGE(32). A detection value may be the first driving voltage VGH, the second driving voltage VGL, or the overcurrent flowing between the power management integrated circuit 140 and the display panel driving circuit 120. Masking ratios may be indicated by OFF to SHUT DOWN.

When the detection value that the display panel protection circuit 150 detects belongs to a first range RANGE(1), the display panel protection circuit 150 may determine that the overcurrent does not flow in the display panel 110. Thus, the display panel protection circuit 150 may not perform the masking driving (i.e., indicated by OFF). In other words, the display panel protection circuit 150 may not perform the masking driving when the register data is '00000'. In addition, when the detection value that the display panel protection circuit 150 detects belongs to a second range RANGE(2), a third range RANGE(3), and a fourth range RANGE(4), the display panel protection circuit 150 may determine that the overcurrent flows in the display panel 110. Thus, the display panel protection circuit 150 may perform the masking driving by setting the masking ratio to be 1:1 when the detection value belongs to the second range RANGE(2). Additionally, the display panel protection circuit 150 may perform the masking driving by setting the masking ratio to be 1:2 when the detection value belongs to the third range RANGE(3). The display panel protection circuit 150 may also perform the masking driving by setting the masking ratio to be 1:3 when the detection value belongs to the fourth range RANGE(4). In other words, the display panel protection circuit 150 may perform the masking driving by setting the masking ratio to be 1:1 when the register data is '00001'. Additionally, the display panel protection circuit 150 may perform the masking driving by setting the masking ratio to be 1:2 when the register data is '00010' and may perform the masking driving by setting the masking ratio to be 1:3 when the register data is '00011'.

Further, when the detection value that the display panel protection circuit 150 detects belongs to a (32)th range RANGE(32), the display panel protection circuit 150 may determine that a serious overcurrent flows in the display panel 110. Thus, the display panel protection circuit 150 may shut down the display panel immediately (i.e., indicated by SHUT DOWN) without performing the masking driving to protect the display panel 110 quickly. In other words, the display panel protection circuit 150 may shut down (or power off) the display panel driving circuit 120 when the register data is '11111'. Since the setting of the masking ratio illustrated in FIG. 3 is an example; the setting of the masking ratio is not limited thereto. For example, the masking ratio may be set in various ways according to product specifications (e.g., an IC performance, a resolution, a driving frequency, a protection level, etc) of the display device 100.

In brief, the display device 100 may monitor a driving voltage provided from the power management integrated circuit 140 to the display panel driving circuit 120. Monitoring a driving voltage may include the first driving voltage VGH corresponding to the gate-on voltage and/or the second driving voltage VGL corresponding to the gate-off voltage. Additionally, the display device 100 may determine at least one frame following a current frame as the masking frame MF, according to the masking ratio, when the driving voltage is outside of a reference voltage range. The display device 100 may also control the driving control circuit 130 not to provide the clock signal CLK and the input data SDI to the display panel driving circuit 120 during the masking frame MF.

In addition, the display device 100 may monitor a current flowing between the power management integrated circuit 140 and the display panel driving circuit 120 (e.g., the first current flowing through the first output terminal of the power management integrated circuit 140 and/or the second current flowing through the second output terminal of the power management integrated circuit 140). Additionally, the display device 100 may determine at least one frame following a current frame as the masking frame MF, according to the masking ratio, when the current is outside of a reference current range. The display device 100 may also control the driving control circuit 130 not to provide the clock signal CLK and the input data SDI to the display panel driving circuit 120 during the masking frame MF. Thus, the display device 100 may minimize the damages of the display panel 110 due to the overcurrent flowing in the display panel 110 while continuously displaying an image on the display panel 110. The display device 100 may minimize the damages of the display panel 110 by reducing the number of normal frames, according to the masking ratio, when the overcurrent flows in the display panel 110. Reducing the number of normal frames NF may include reducing the driving frequency of the display panel 110. As a result, the display device 100 may prevent the damages of the display panel 110 and/or the product liability accident due to the damages of the display panel 110 while continuously operating the display panel 110 when the overcurrent flows in the display panel 110.

Thus, when the display device 100 is implemented in a vehicle, the display device 100 may prevent a situation in which driving the vehicle becomes difficult as the display panel 110 may not operate properly. Additionally, the display device 100 may prevent a product liability situation, such as an explosion, ignition, or fire, as the display panel 110 operates under poor conditions.

Figure 4:
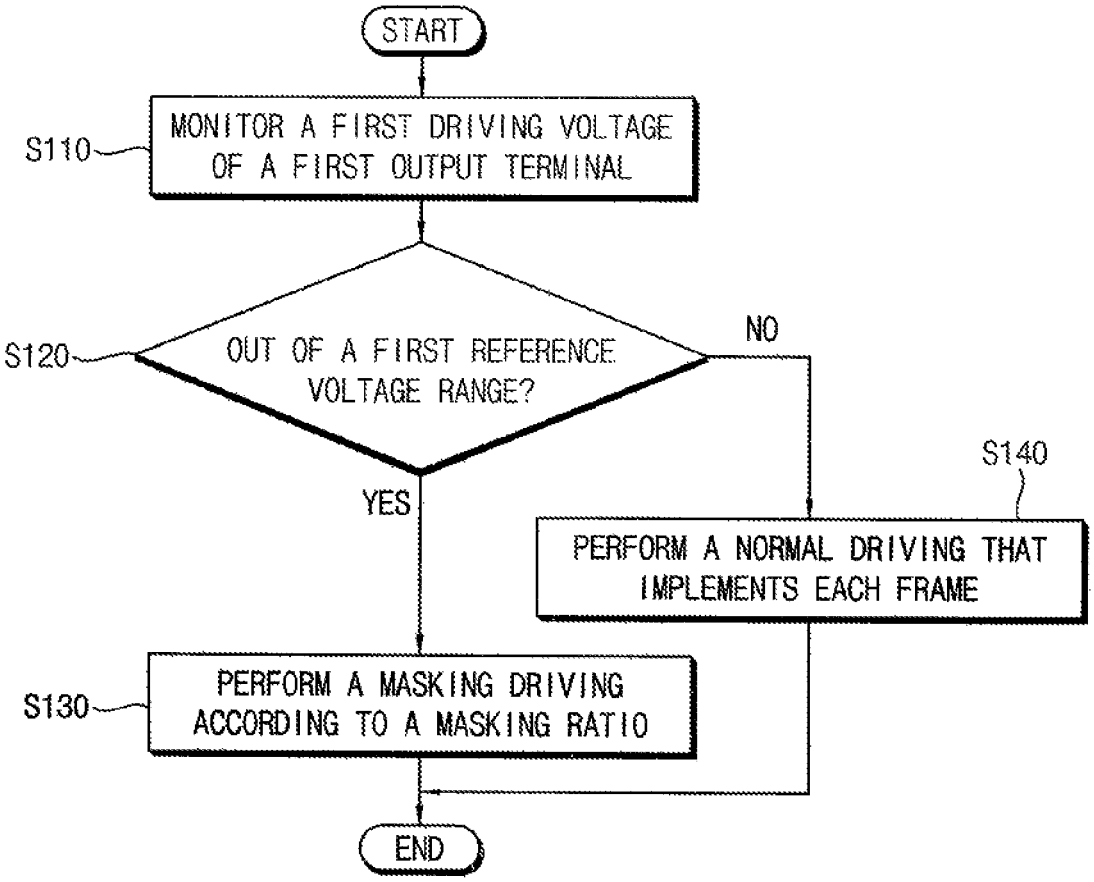
FIG. 4 is a flowchart illustrating an example in which a display panel protection circuit included in the display device of FIG. 1 operates.
Figure 5:
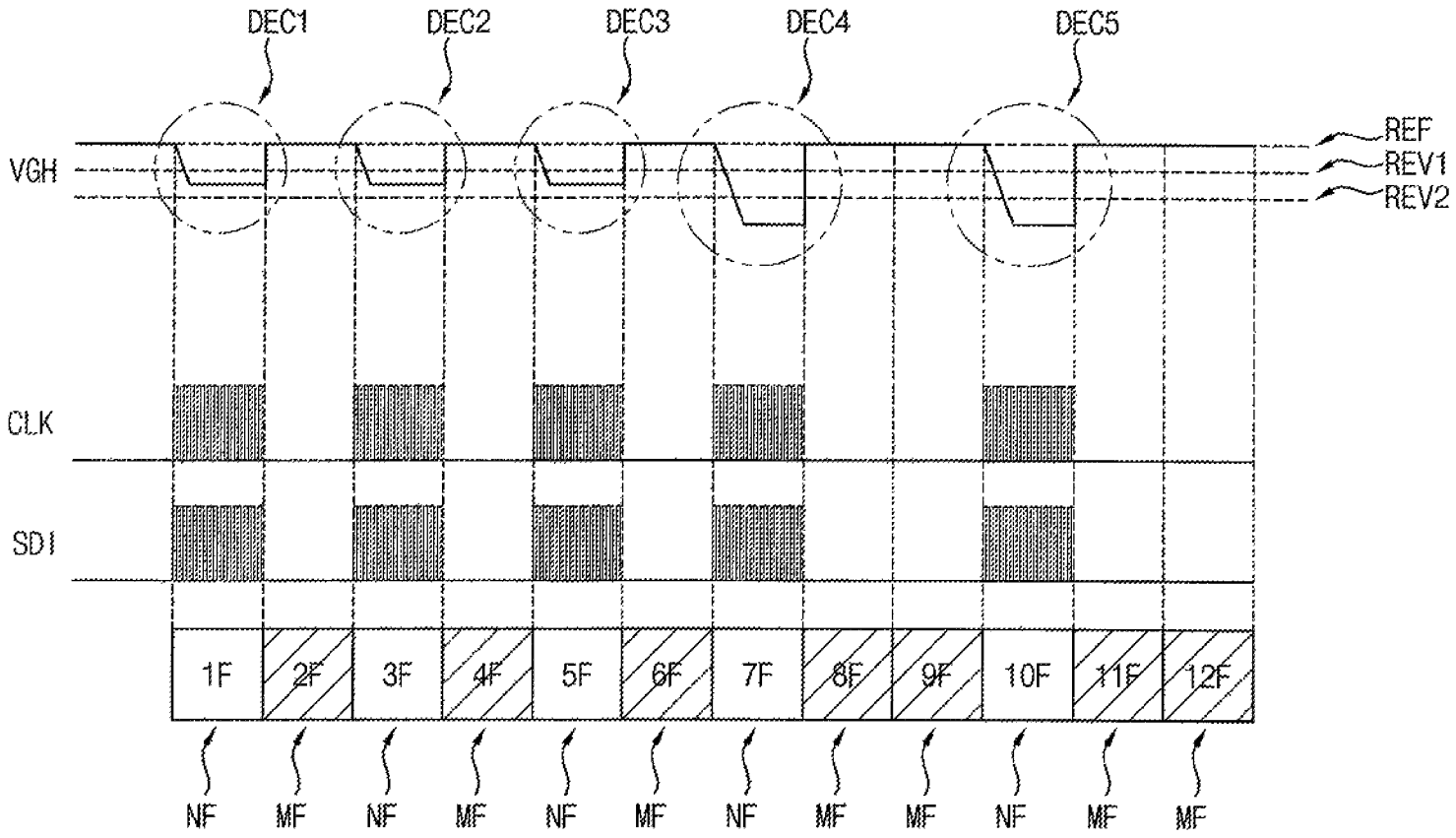
FIG. 5 is a diagram for describing an example in which a display panel protection circuit included in the display device of FIG. 1 operates.

FIG. 4 is a flowchart illustrating an example in which a display panel protection circuit included in the display device of FIG. 1 operates, and FIG. 5 is a diagram for describing an example in which a display panel protection circuit included in the display device of FIG. 1 operates.

Referring to FIGS. 4 and 5, the display panel protection circuit 150 may monitor the first driving voltage VGH of the first output terminal of the power management integrated circuit 140 (S110) and may check whether the first driving voltage VGH is outside of the first reference voltage range (S120). When the first driving voltage VGH is outside of the first reference voltage range, the display panel protection circuit 150 may perform the masking driving according to the masking ratio (S130). As described above, when the first driving voltage VGH is outside of the first reference voltage range, the display panel protection circuit 150 may perform the masking driving. Masking driving is performed by determining at least one frame following a current frame as the masking frame MF, according to the masking ratio. Masking driving may also be performed by controlling the driving control circuit 130 not to provide the clock signal CLK and the input data SDI to the display panel driving circuit 120 during the masking frame MF.

Conversely, when the first driving voltage VGH is within the first reference voltage range, the display panel protection circuit 150 may determine that the first driving voltage VGH is within a normal range and may perform the normal driving that implements each frame (S140). In example embodiments, the first reference voltage range (e.g., a range between REF and REV1) corresponding to the normal range of the first driving voltage VGH may be set in various ways according to requirements. In addition, the display panel protection circuit 150 may determine whether the driving control circuit 130 is to provide the clock signal CLK and the input data SDI to the display panel driving circuit 120 by monitoring the first driving voltage VGH in each normal frame NF during which an image is displayed.

For example, as illustrated in FIG. 5, the display panel protection circuit 150 may determine that the first driving voltage VGH is outside of the first reference voltage range (e.g., the range between REF and REV1) in a first frame 1F (i.e., indicated by DEC1). Thus, the display panel protection circuit 150 may perform the masking driving due to the determination that an overcurrent flows in the display panel 110 during the first frame 1F. Since the first driving voltage VGH has a voltage level between a first voltage level REV1 and a second voltage level REV2, the display panel protection circuit 150 may determine a second frame 2F following a current frame (i.e., the first frame 1F) as the masking frame MF according to the masking ratio of 1:1.

Subsequently, the display panel protection circuit 150 may determine that the first driving voltage VGH is outside of the first reference voltage range (e.g., the range between REF and REV1) in a third frame 3F (i.e., indicated by DEC2). Thus, the display panel protection circuit 150 may perform the masking driving due to the determination that an overcurrent flows in the display panel 110 during the third frame 3F. Since the first driving voltage VGH has a voltage level between the first voltage level REV1 and the second voltage level REV2, the display panel protection circuit 150 may determine a fourth frame 4F following a current frame (i.e., the third frame 3F) as the masking frame MF according to the masking ratio of 1:1.

Next, the display panel protection circuit 150 may determine that the first driving voltage VGH is outside of the first reference voltage range (e.g., the range between REF and REV1) in a fifth frame 5F (i.e., indicated by DEC3). Thus, the display panel protection circuit 150 may perform the masking driving due to the determination that an overcurrent flows in the display panel 110 during the fifth frame 5F. Since the first driving voltage VGH has a voltage level between the first voltage level REV1 and the second voltage level REV2, the display panel protection circuit 150 may determine a sixth frame 6F following a current frame (i.e., the fifth frame 5F) as the masking frame MF according to the masking ratio of 1:1. For example, the display panel protection circuit 150 may monitor the first driving voltage VGH in each normal frame NF among the first through sixth frames 1F through 6F. The display panel protection circuit 150 may also perform the masking driving based on the masking ratio of 1:1, which is determined according to a magnitude of the first driving voltage VGH. For example, the driving frequency of the display panel 110 is reduced to ½ of the normal driving frequency of the display panel 110.

Subsequently, the display panel protection circuit 150 may determine that the first driving voltage VGH is outside of the first reference voltage range (e.g., the range between REF and REV1) in a seventh frame 7F (i.e., indicated by DEC4). Thus, the display panel protection circuit 150 may perform the masking driving due to the determination that an overcurrent flows in the display panel 110 during the seventh frame 7F. Since the first driving voltage VGH has a voltage level lower than the second voltage level REV2, the display panel protection circuit 150 may determine an eighth frame 8F and a ninth frame 9F following a current frame (i.e., the seventh frame 7F) as the masking frame MF, according to the masking ratio of 1:2. Next, the display panel protection circuit 150 may determine that the first driving voltage VGH is outside of the first reference voltage range (e.g., the range between REF and REV1) in a tenth frame 10F (i.e., indicated by DEC5). Thus, the display panel protection circuit 150 may perform the masking driving due to the determination that an overcurrent flows in the display panel 110 during the tenth frame 10F. Since the first driving voltage VGH has a voltage level lower than the second voltage level REV2, the display panel protection circuit 150 may determine an eleventh frame 11F and a twelfth frame 12F following a current frame (i.e., the tenth frame 10F) as the masking frame MF, according to the masking ratio of 1:2. For example, the display panel protection circuit 150 may monitor the first driving voltage VGH in each normal frame NF among the seventh through twelfth frames 7F through 12F. The display panel protection circuit 150 may also perform the masking driving based on the masking ratio of 1:2 which is determined according to a magnitude of the first driving voltage VGH. For example, the driving frequency of the display panel 110 is reduced to ⅓ of the normal driving frequency of the display panel 110.

Although it is described above that an overcurrent flows in the display panel 110 during the first frame 1F, during the third frame 3F, during the fifth frame 5F, during the seventh frame 7F, and during the tenth frame 10F, it may be determined that an overcurrent does not flow in the display panel 110 at some detection times after the first detection time (i.e., DEC1). Overcurrent flows in the display panel 110 at certain detection times (i.e., DEC2, DEC3, DEC4, and DEC5) after the first detection time (i.e., DEC1) due to overcurrent flows in the display panel 110 from a short circuit of wirings included in the display panel 110.

Figure 6:
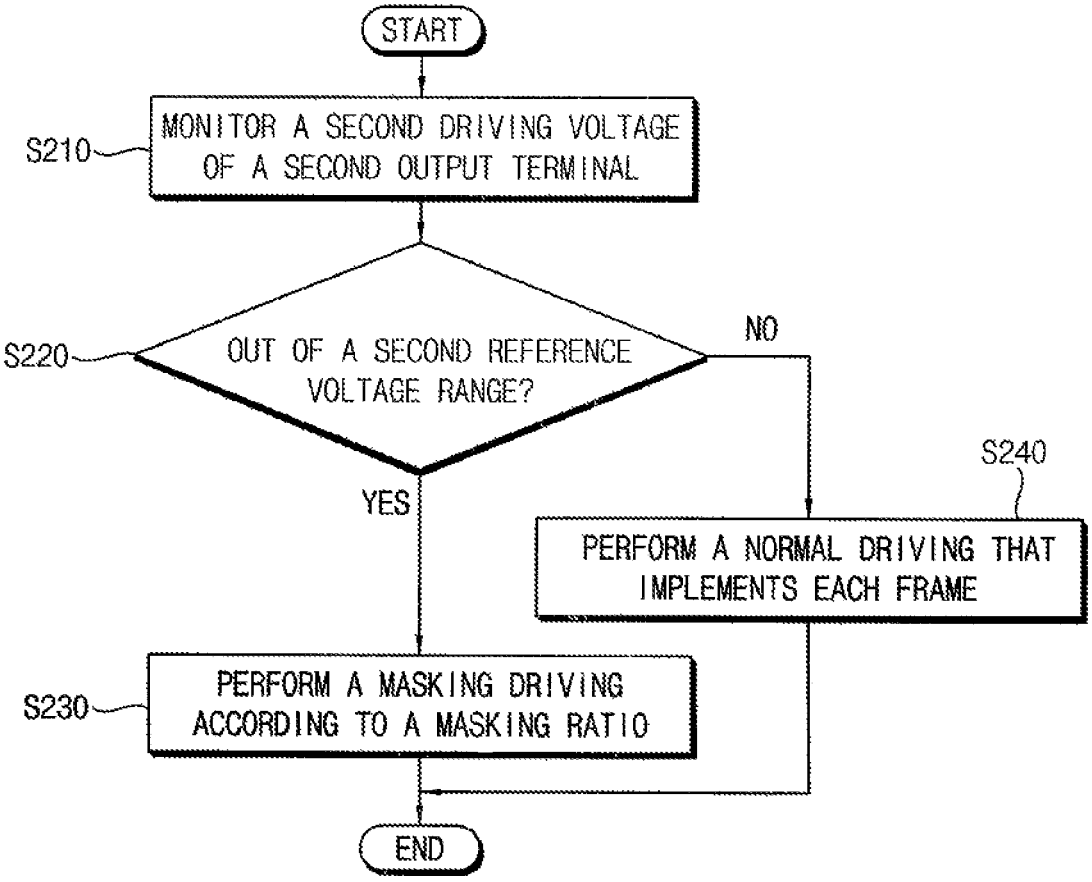
FIG. 6 is a flowchart illustrating another example in which a display panel protection circuit included in the display device of FIG. 1 operates.
Figure 7:
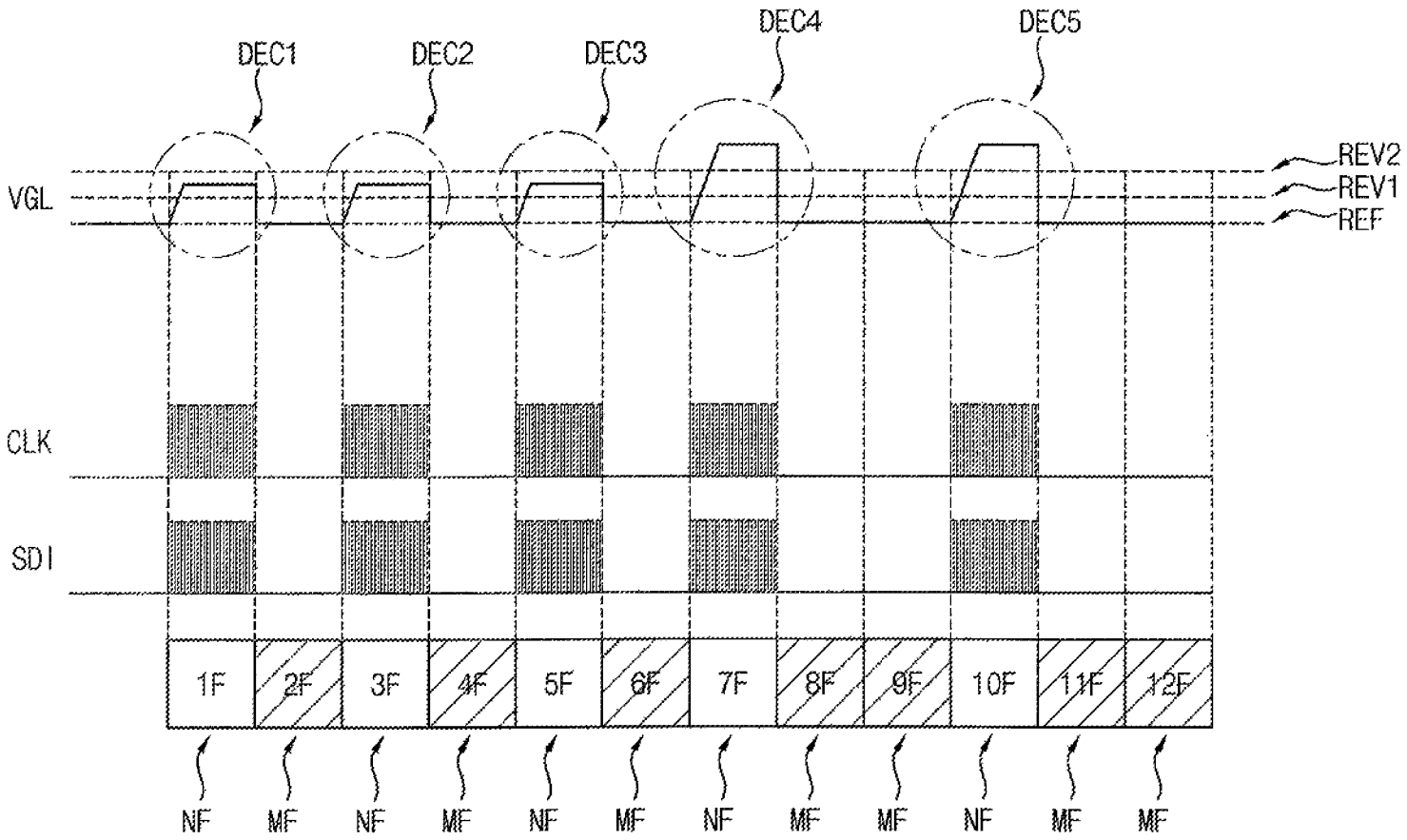
FIG. 7 is a diagram for describing another example in which a display panel protection circuit included in the display device of FIG. 1 operates.

FIG. 6 is a flowchart illustrating another example in which a display panel protection circuit included in the display device of FIG. 1 operates, and FIG. 7 is a diagram for describing another example in which a display panel protection circuit included in the display device of FIG. 1 operates.

Referring to FIGS. 6 and 7, the display panel protection circuit 150 may monitor the second driving voltage VGL of the second output terminal of the power management integrated circuit 140 (S210) and may check whether the second driving voltage VGL is outside of the second reference voltage range (S220). When the second driving voltage VGL is outside of the second reference voltage range, the display panel protection circuit 150 may perform the masking driving according to the masking ratio (S230). As described above, when the second driving voltage VGL is outside of the second reference voltage range, the display panel protection circuit 150 may perform the masking driving. The masking driving is performed by determining at least one frame following a current frame as the masking frame MF, according to the masking ratio. The masking driving is also performed by controlling the driving control circuit 130 not to provide the clock signal CLK and the input data SDI to the display panel driving circuit 120 during the masking frame MF.

Conversely, when the second driving voltage VGL is within the second reference voltage range, the display panel protection circuit 150 may determine that the second driving voltage VGL is within a normal range and may perform the normal driving that implements each frame (S240). In example embodiments, the second reference voltage range (e.g., a range between REF and REV1) corresponding to the normal range of the second driving voltage VGL may be set in various ways according to requirements. In addition, the display panel protection circuit 150 may determine whether the driving control circuit 130 is to provide the clock signal CLK and the input data SDI to the display panel driving circuit 120 by monitoring the second driving voltage VGL in each normal frame NF during which an image is displayed.

For example, as illustrated in FIG. 7, the display panel protection circuit 150 may determine that the second driving voltage VGL is outside of the second reference voltage range (e.g., the range between REF and REV1) in a first frame 1F (i.e., indicated by DEC1). Thus, the display panel protection circuit 150 may perform the masking driving because it is determined that an overcurrent flows in the display panel 110 during the first frame 1F. Since the second driving voltage VGL has a voltage level between a first voltage level REV1 and a second voltage level REV2, the display panel protection circuit 150 may determine a second frame 2F following a current frame (i.e., the first frame 1F) as the masking frame MF according to the masking ratio of 1:1. Subsequently, the display panel protection circuit 150 may determine that the second driving voltage VGL is outside of the second reference voltage range (e.g., the range between REF and REV1) in a third frame 3F (i.e., indicated by DEC2). Thus, the display panel protection circuit 150 may perform the masking driving because it is determined that an overcurrent flows in the display panel 110 during the third frame 3F. Since the second driving voltage VGL has a voltage level between the first voltage level REV1 and the second voltage level REV2, the display panel protection circuit 150 may determine a fourth frame 4F following a current frame (i.e., the third frame 3F) as the masking frame MF according to the masking ratio of 1:1. Next, the display panel protection circuit 150 may determine that the second driving voltage VGL is outside of the second reference voltage range (e.g., the range between REF and REV1) in a fifth frame 5F (i.e., indicated by DEC3). Thus, the display panel protection circuit 150 may perform the masking driving because it is determined that an overcurrent flows in the display panel 110 during the fifth frame 5F. Since the second driving voltage VGL has a voltage level between the first voltage level REV1 and the second voltage level REV2, the display panel protection circuit 150 may determine a sixth frame 6F following a current frame (i.e., the fifth frame 5F) as the masking frame MF according to the masking ratio of 1:1. For example, the display panel protection circuit 150 may monitor the second driving voltage VGL in each normal frame NF among the first through sixth frames 1F through 6F and may perform the masking driving based on the masking ratio of 1:1 which is determined according to a magnitude of the second driving voltage VGL (i.e., the driving frequency of the display panel 110 is reduced to ½ of the normal driving frequency of the display panel 110).

Subsequently, the display panel protection circuit 150 may determine that the second driving voltage VGL is outside of the second reference voltage range (e.g., the range between REF and REV1) in a seventh frame 7F (i.e., indicated by DEC4). Thus, the display panel protection circuit 150 may perform the masking driving because it is determined that an overcurrent flows in the display panel 110 during the seventh frame 7F. Since the second driving voltage VGL has a voltage level higher than the second voltage level REV2, the display panel protection circuit 150 may determine an eighth frame 8F and a ninth frame 9F following a current frame (i.e., the seventh frame 7F) as the masking frame MF according to the masking ratio of 1:2. Next, the display panel protection circuit 150 may determine that the second driving voltage VGL is outside of the second reference voltage range (e.g., the range between REF and REV1) in a tenth frame 10F (i.e., indicated by DEC5). Thus, the display panel protection circuit 150 may perform the masking driving because it is determined that an overcurrent flows in the display panel 110 during the tenth frame 10F. Since the second driving voltage VGL has a voltage level higher than the second voltage level REV2, the display panel protection circuit 150 may determine an eleventh frame 11F and a twelfth frame 12F following a current frame (i.e., the tenth frame 10F) as the masking frame MF according to the masking ratio of 1:2. For example, the display panel protection circuit 150 may monitor the second driving voltage VGL in each normal frame NF among the seventh through twelfth frames 7F through 12F and may perform the masking driving based on the masking ratio of 1:2 which is determined according to a magnitude of the second driving voltage VGL (i.e., the driving frequency of the display panel 110 is reduced to ⅓ of the normal driving frequency of the display panel 110). Although it is described above that an overcurrent flows in the display panel 110 during the first frame 1F, during the third frame 3F, during the fifth frame 5F, during the seventh frame 7F, and during the tenth frame 10F, it may be determined that an overcurrent does not flow in the display panel 110 at some detection times after the first detection time (i.e., DEC1). However, because an overcurrent flows in the display panel 110 due to a short circuit and the like of wirings included in the display panel 110, it may be natural that an overcurrent flows in the display panel 110 at certain detection times (i.e., DEC2, DEC3, DEC4, and DEC5) after the first detection time (i.e., DEC1).

Figure 8:
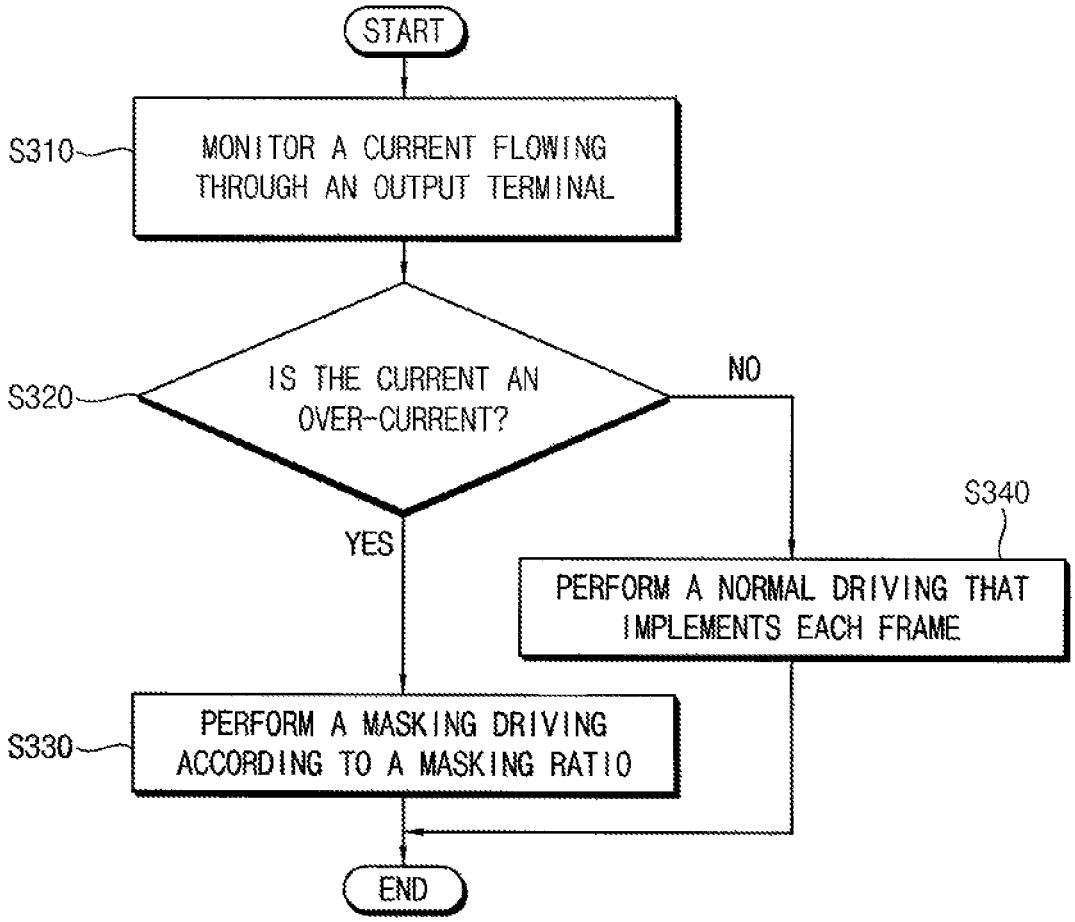
FIG. 8 is a flowchart illustrating still another example in which a display panel protection circuit included in the display device of FIG. 1 operates.
Figure 9:
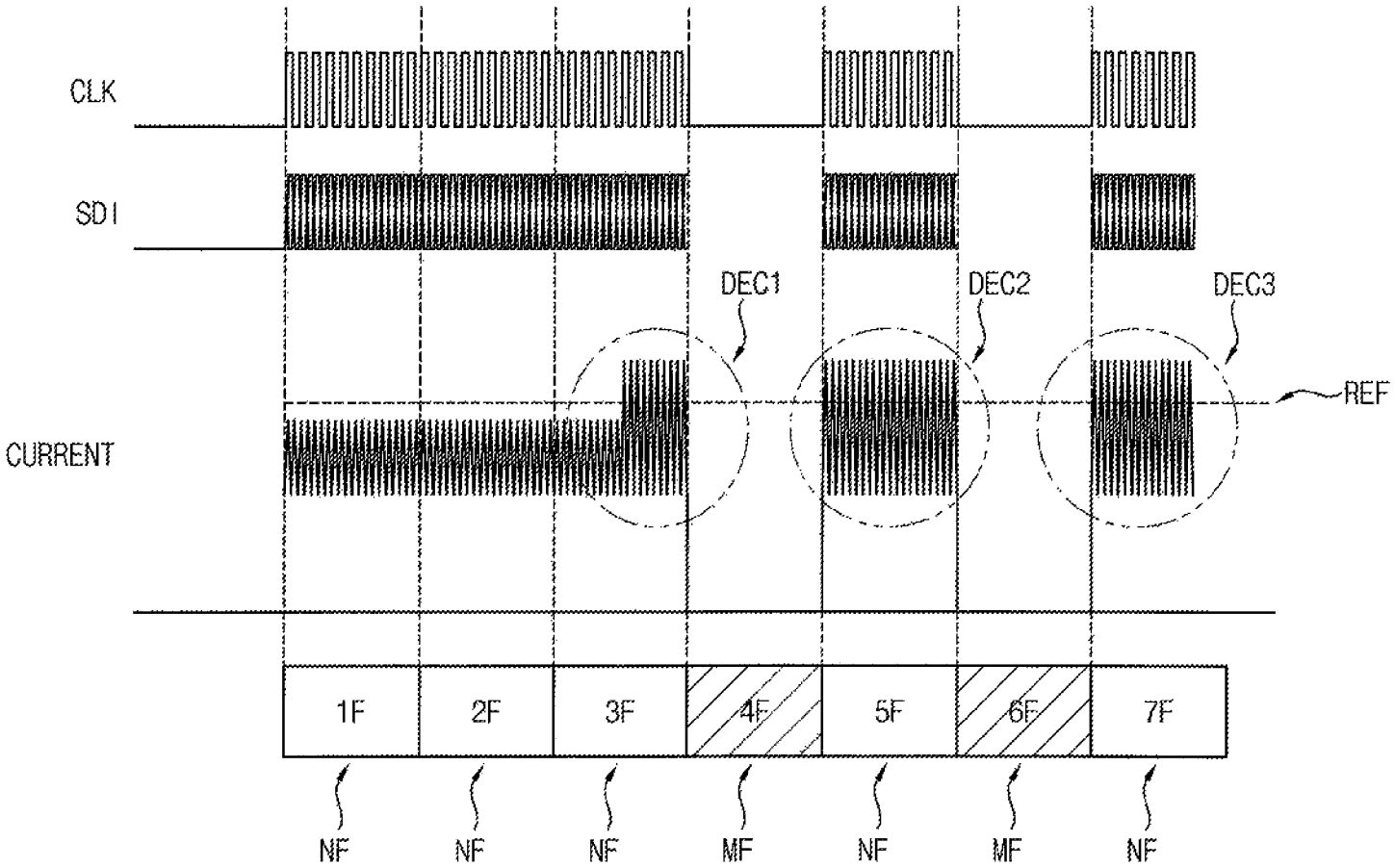
FIG. 9 is a diagram for describing still another example in which a display panel protection circuit included in the display device of FIG. 1 operates.

FIG. 8 is a flowchart illustrating still another example in which a display panel protection circuit included in the display device of FIG. 1 operates, and FIG. 9 is a diagram for describing still another example in which a display panel protection circuit included in the display device of FIG. 1 operates.

Referring to FIGS. 8 and 9, the display panel protection circuit 150 may monitor a first current flowing through the first output terminal of the power management integrated circuit 140 and/or a second current flowing through the second output terminal of the power management integrated circuit 140 (S310) and may check whether the first current and/or the second current is an overcurrent (S320). When the first current and/or the second current is the overcurrent, the display panel protection circuit 150 may perform the masking driving according to the masking ratio (S330). As described above, when the first current and/or the second current is the overcurrent, the display panel protection circuit 150 may perform the masking driving by determining at least one frame following a current frame as the masking frame MF according to the masking ratio and by controlling the driving control circuit 130 not to provide the clock signal CLK and the input data SDI to the display panel driving circuit 120 during the masking frame MF. On the other hand, when the first current and/or the second current is not the overcurrent, the display panel protection circuit 150 may determine that the first current and/or the second current is within a normal range and may perform the normal driving that implements each frame (S340). In example embodiments, the normal range (e.g., a range lower than REF) of the first current and/or the second current may be set in various ways according to requirements. In addition, the display panel protection circuit 150 may determine whether the driving control circuit 130 is to provide the clock signal CLK and the input data SDI to the display panel driving circuit 120 by monitoring the first current and/or the second current in each normal frame NF during which an image is displayed.

For example, as illustrated in FIG. 9, the display panel protection circuit 150 may determine that the first current and/or the second current is not the overcurrent in a first frame 1F. Thus, the display panel protection circuit 150 may perform normal driving. Subsequently, the display panel protection circuit 150 may determine that the first current and/or the second current is not the overcurrent in a second frame 2F. Thus, the display panel protection circuit 150 may perform normal driving. Next, the display panel protection circuit 150 may determine that the first current and/or the second current is the overcurrent in a third frame 3F (i.e., indicated by DEC1). Thus, the display panel protection circuit 150 may perform the masking driving because it is determined that an overcurrent flows in the display panel 110 during the third frame 3F. Since the first current and/or the second current have a current level higher than a reference current level REF, the display panel protection circuit 150 may determine a fourth frame 4F following a current frame (i.e., the third frame 3F) as the masking frame MF according to the masking ratio of 1:1. Subsequently, the display panel protection circuit 150 may determine that the first current and/or the second current is the overcurrent in a fifth frame 5F (i.e., indicated by DEC2). Thus, the display panel protection circuit 150 may perform the masking driving because it is determined that an overcurrent flows in the display panel 110 during the fifth frame 5F.

Since the first current and/or the second current have a current level higher than the reference current level REF, the display panel protection circuit 150 may determine a sixth frame 6F following a current frame (i.e., the fifth frame 5F) as the masking frame MF according to the masking ratio of 1:1. Next, the display panel protection circuit 150 may determine that the first current and/or the second current is the overcurrent in a seventh frame 7F (i.e., indicated by DEC3). Thus, the display panel protection circuit 150 may perform the masking driving because it is determined that an overcurrent flows in the display panel 110 during the seventh frame 7F. Since the first current and/or the second current have a current level higher than the reference current level REF, the display panel protection circuit 150 may determine an eighth frame 8F following a current frame (i.e., the seventh frame 7F) as the masking frame MF according to the masking ratio of 1:1. For example, the display panel protection circuit 150 may monitor the first current and/or the second current in each normal frame NF and may perform the masking driving based on the masking ratio of 1:1. A masking ratio of 1:1 is determined according to a magnitude of the first current and/or the second current (i.e., the driving frequency of the display panel 110 is reduced to ½ of the normal driving frequency of the display panel 110). An overcurrent may flow in the display panel 110 at certain detection times (i.e., DEC2 and DEC3) after the first detection time (i.e., DEC1) when an overcurrent flows in the display panel 110 due to a short circuit and the like of wirings included in the display panel 110, FIG. 10 is a block diagram illustrating an electronic device according to example embodiments, and FIG. 11 is a diagram illustrating an example in which the electronic device of FIG. 10 is implemented as a smartphone.

Figure 10:
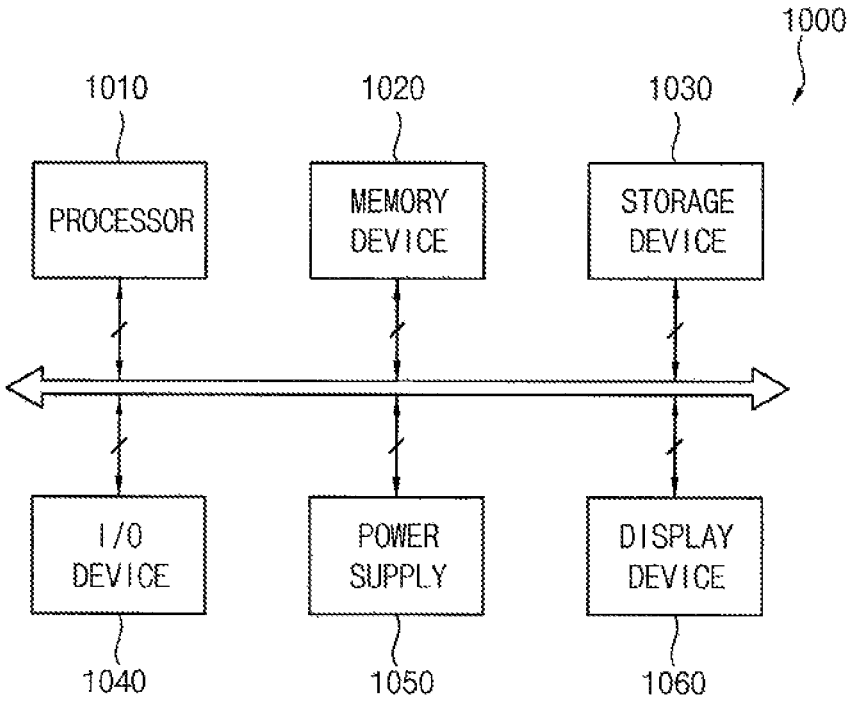
FIG. 10 is a block diagram illustrating an electronic device according to example embodiments.
Figure 11:
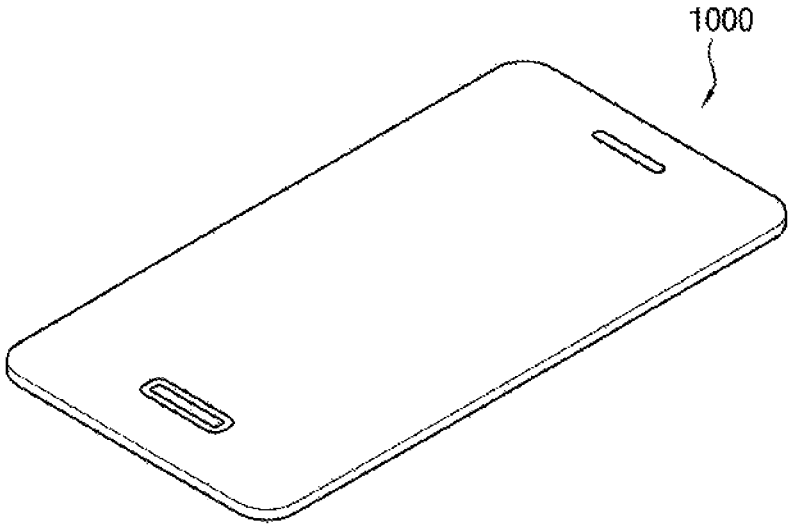
FIG. 11 is a diagram illustrating an example in which the electronic device of FIG. 10 is implemented as a smartphone.

Referring to FIGS. 10 and 11, the electronic device 1000 may include a processor 1010, a memory device 1020, a storage device 1030, an input/output (I/O) device 1040, a power supply 1050, and a display device 1060. The display device 1060 may be the display device 100 of FIG. 1. In addition, the electronic device 1000 may further include a plurality of ports for communicating with a video card, a sound card, a memory card, a universal serial bus (USB) device, other electronic devices, etc. In an example embodiment, as illustrated in FIG. 11, the electronic device 1000 may be implemented as a smartphone. However, the electronic device 1000 is not limited thereto. For example, the electronic device 1000 may be implemented as a car navigation system, a car display unit, a car side mirror, a car rear mirror, a cellular phone, a video phone, a smart pad, a smartwatch, a tablet PC, a television, a computer monitor, a laptop, a head-mounted display (HMD) device, etc.

The processor 1010 may perform various computing functions. The processor 1010 may be a microprocessor, a central processing unit (CPU), an application processor (AP), etc. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc and/or at least one volatile memory device such as a dynamic random access memory (DRAM) device, a static random access memory (SRAM) device, a mobile DRAM device, etc. The storage device 1030 may include a solid-state drive (SSD) device, a hard disk drive (HDD) device, a CD-ROM device, etc. The I/O device 1040 may include an input device such as a keyboard, a keypad, a mouse device, a touch-pad, a touch-screen, etc, and an output device such as a printer, a speaker, etc. The power supply 1050 may provide power for operations of the electronic device 1000.

The display device 1060 may be coupled to other components via the buses or other communication links. In some example embodiments, the display device 1060 may be included in the I/O device 1040. As described above, the display device 1060 may minimize damages of a display panel due to an overcurrent flowing in the display panel while continuously displaying an image on the display panel by reducing the number of a normal frame (i.e., reducing a driving frequency of the display panel) according to a masking ratio when the overcurrent flows in the display panel.

The display device 1060 may include a display panel, a display panel driving circuit, a first driving voltage, a second driving voltage, a driving control circuit, a power management integrated circuit, and a display panel protection circuit. The display panel displays an image. The display panel driving circuit drives the display panel by generating a gate signal based on a clock signal. The first driving voltage corresponds to a gate-on voltage and a second driving voltage corresponds to a gate-off voltage. The first driving voltage and the second driving voltage generate a data signal based on input data and by providing the gate signal and the data signal to the display panel. The driving control circuit controls the display panel driving circuit by providing the clock signal and the input data to the display panel driving circuit and by providing at least one control signal to the display panel driving circuit. The power management integrated circuit provides the first driving voltage and the second driving voltage to the display panel driving circuit through a first output terminal and a second output terminal, respectively. The display panel protection circuit performs a masking driving on the display panel when an overcurrent flows in the display panel.

In an example embodiment, the display panel protection circuit may monitor a driving voltage provided from the power management integrated circuit to the display panel driving circuit. For example, the first driving voltage corresponding to the gate-on voltage and/or the second driving voltage corresponding to the gate-off voltage. Additionally, the display panel protection circuit may determine at least one frame following a current frame as the masking frame according to the masking ratio when the driving voltage is outside of a reference voltage range. The display panel protection circuit may also control the driving control circuit not to provide the clock signal and the input data to the display panel driving circuit during the masking frame.

In another example embodiment, the display panel protection circuit may monitor a current flowing between the power management integrated circuit and the display panel driving circuit. Additionally, the display panel protection circuit may determine at least one frame following a current frame as the masking frame according to the masking ratio when the current is outside of a reference current range (i.e., when the current is judged to be an overcurrent). The display panel protection circuit may also control the driving control circuit not to provide the clock signal and the input data to the display panel driving circuit during the masking frame. Since these are described above, a duplicated description related thereto will not be repeated.

The present inventive concept may be applied to a display device and an electronic device including the display device. For example, the present inventive concept may be applied to a car navigation system, a car display unit, a car side mirror, a car rear mirror, a cellular phone, a smartphone, a video phone, a smart pad, a smartwatch, a tablet PC, a television, a computer monitor, a laptop, a head-mounted display (HMD) device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed and that modifications to the disclosed example embodiments, as well as other example embodiments, are intended to be included within the scope of the appended claims.

What is claimed is:

1. A display device comprising:

a display panel configured to display an image;

a display panel driving circuit configured to drive the display panel by generating a gate signal based on a clock signal, a first driving voltage corresponding to a gate-on voltage, and a second driving voltage corresponding to a gate-off voltage, by generating a data signal based on input data, and by providing the gate signal and the data signal to the display panel;

a driving control circuit configured to control the display panel driving circuit by providing the clock signal and the input data to the display panel driving circuit and by providing at least one control signal to the display panel driving circuit;

a power management integrated circuit configured to provide the first driving voltage and the second driving voltage to the display panel driving circuit through a first output terminal and a second output terminal, respectively; and a display panel protection circuit configured to monitor the first driving voltage of the first output terminal, to identify a masking ratio for a period of a masking driving when the first driving voltage is out of a first reference voltage range, to determine at least one frame following a current frame as a masking frame according to the masking ratio, and to prevent the driving control circuit from providing the clock signal and the input data to the display panel driving circuit during the masking frame.

2. The display device of claim 1, wherein the display panel protection circuit determines whether the driving control circuit is to provide the clock signal and the input data to the display panel driving circuit by monitoring the first driving voltage in normal frames during which the image is displayed.

3. The display device of claim 1, wherein the masking ratio indicates a ratio of a number of the masking frames during the period of the masking driving to a number of normal frames that during the period, and wherein the masking ratio is stored in a mapping table form in a memory device and is referred to by the display panel protection circuit.

4. The display device of claim 3, wherein the masking ratio is independent of a magnitude of the first driving voltage.

5. The display device of claim 3, wherein the masking ratio depends on a magnitude of the first driving voltage.

6. The display device of claim 5, wherein the masking ratio increases as an amount by which the first driving voltage is out of the first reference voltage range increases, and a driving frequency of the display panel decreases as the masking ratio increases.

7. The display device of claim 5, wherein the masking ratio decreases as an amount by which the first driving voltage is out of the first reference voltage range decreases, and a driving frequency of the display panel increases as the masking ratio decreases.

8. A display device comprising:

a display panel configured to display an image;

a display panel driving circuit configured to drive the display panel by generating a gate signal based on a clock signal, a first driving voltage corresponding to a gate-on voltage, and a second driving voltage corresponding to a gate-off voltage, by generating a data signal based on input data, and by providing the gate signal and the data signal to the display panel;

a driving control circuit configured to control the display panel driving circuit by providing the clock signal and the input data to the display panel driving circuit and by providing at least one control signal to the display panel driving circuit;

a power management integrated circuit configured to provide the first driving voltage and the second driving voltage to the display panel driving circuit through a first output terminal and a second output terminal, respectively; and a display panel protection circuit configured to monitor the second driving voltage of the second output terminal, to identify a masking ratio for a period of a masking driving when the second driving voltage is out of a second reference voltage range, to determine at least one frame following a current frame as the masking frame according to a masking ratio, and to prevent the driving control circuit from providing the clock signal and the input data to the display panel driving circuit during the masking frame.

9. The display device of claim 8, wherein the display panel protection circuit determines whether the driving control circuit is to provide the clock signal and the input data to the display panel driving circuit by monitoring the second driving voltage in normal frames during which the image is displayed.

10. The display device of claim 8, wherein the masking ratio indicates a ratio of a number of the masking frames during the period of the masking driving to a number of normal frames that during the period, and wherein the masking ratio is stored in a mapping table form in a memory device and is referred to by the display panel protection circuit.

11. The display device of claim 10, wherein the masking ratio is independent of a magnitude of the second driving voltage.

12. The display device of claim 10, wherein the masking ratio depends on a magnitude of the second driving voltage.

13. The display device of claim 12, wherein the masking ratio increases as an amount by which the second driving voltage is out of the second reference voltage range increases, and a driving frequency of the display panel decreases as the masking ratio increases.

14. The display device of claim 12, wherein the masking ratio decreases as an amount by which the second driving voltage is out of the second reference voltage range decreases, and a driving frequency of the display panel increases as the masking ratio decreases.

15. A display device comprising:

a display panel configured to display an image;

a display panel driving circuit configured to drive the display panel by generating a gate signal based on a clock signal, a first driving voltage corresponding to a gate-on voltage, and a second driving voltage corresponding to a gate-off voltage, by generating a data signal based on input data, and by providing the gate signal and the data signal to the display panel;

a driving control circuit configured to control the display panel driving circuit by providing the clock signal and the input data to the display panel driving circuit and by providing at least one control signal to the display panel driving circuit;

a power management integrated circuit configured to provide the first driving voltage and the second driving voltage to the display panel driving circuit through a first output terminal and a second output terminal, respectively; and a display panel protection circuit configured to monitor at least one selected from a first current flowing through the first output terminal and a second current flowing through the second output terminal, to determine at least one frame following a current frame as a masking frame according to a masking ratio when the at least one selected from the first current and the second current is judged to be an overcurrent, and to prevent the driving control circuit from providing the clock signal and the input data to the display panel driving circuit during the masking frame.

16. The display device of claim 15, wherein the display panel protection circuit determines whether the driving control circuit is to provide the clock signal and the input data to the display panel driving circuit by monitoring the at least one selected from the first current and the second current in normal frames during which the image is displayed.

17. The display device of claim 15, wherein the masking ratio indicates a ratio of a number of the masking frames during a period of a masking driving to a number of normal frames that during the period, and wherein the masking ratio is stored in a mapping table form in a memory device and is referred to by the display panel protection circuit.

18. The display device of claim 17, wherein the masking ratio is independent of a magnitude of the overcurrent.

19. The display device of claim 17, wherein the masking ratio depends on a magnitude of the overcurrent.

20. The display device of claim 19, wherein the masking ratio increases as the overcurrent increases, and a driving frequency of the display panel decreases as the masking ratio increases, and wherein the masking ratio decreases as the overcurrent decreases, and the driving frequency of the display panel increases as the masking ratio decreases.

* * * * *